US011078930B2

(12) United States Patent
Rauwolf et al.

(10) Patent No.: US 11,078,930 B2
(45) Date of Patent: Aug. 3, 2021

(54) HYDROMECHANICAL LINEAR CONVERTER

(71) Applicant: HAWE Altenstadt Holding GmbH, Altenstadt (DE)

(72) Inventors: Martin Rauwolf, Schongau (DE); Josef Ritzl, Peiting (DE); Andreas Socher, Altenstadt (DE)

(73) Assignee: HAWE Altenstadt Holding GmbH, Kessel (DE)

( * ) Notice: Subject to any disclaimer, the term of this patent is extended or adjusted under 35 U.S.C. 154(b) by 0 days.

(21) Appl. No.: 16/910,280

(22) Filed: Jun. 24, 2020

(65) Prior Publication Data

US 2020/0408227 A1 Dec. 31, 2020

(30) Foreign Application Priority Data

Jun. 28, 2019 (DE) ..... 10 2019 209 440.6

(51) Int. Cl.
*F15B 13/04* (2006.01)

(52) U.S. Cl.
CPC ..... *F15B 13/0405* (2013.01); *F15B 2211/426* (2013.01); *F15B 2211/428* (2013.01)

(58) Field of Classification Search
CPC ..... F15B 13/0405; F15B 2211/41581
See application file for complete search history.

(56) References Cited

U.S. PATENT DOCUMENTS

2017/0350426 A1* 12/2017 Bohner ..... F15B 15/1409

FOREIGN PATENT DOCUMENTS

| | | | |
|---|---|---|---|
| DE | 102016118853 | B3 | 10/2017 |
| DE | 102017212450 | A1 | 1/2019 |
| EP | 0967028 | B1 | 4/2004 |

* cited by examiner

*Primary Examiner* — F Daniel Lopez
(74) *Attorney, Agent, or Firm* — Dinsmore & Shohl LLP

(57) ABSTRACT

A hydromechanical linear converter has a cylinder, a piston unit and a seat valve unit. The cylinder and a piston of the piston unit delimit a hydraulic working chamber, into which a working connection and a further fluid connection open, and has a supply connection 10. The valve unit switches between a first position connecting the supply connection to the fluid connection and a second position blocking the fluid connection from the supply connection. The linear converter includes a valve housing with a valve seat 16, a valve body with a valve head cooperating with the seat, a spring unit preloading the valve body into a position corresponding to the first position and an electromagnetic actuator 14 acting on the valve body 12 by purely mechanical action, to move the valve body against the force of the spring unit into a position corresponding to the second switching position.

15 Claims, 3 Drawing Sheets

HYDROMECHANICAL LINEAR CONVERTER

CROSS-REFERENCE TO RELATED APPLICATION

This application claims priority from Application No. DE 10 2019 209 440.6 filed Jun. 28, 2019, the entire content of which is incorporated herein by reference.

FIELD OF THE INVENTION

The present invention relates to a hydromechanical linear converter comprising a cylinder, a piston unit movable relative thereto and a valve unit, wherein the cylinder and a piston of the piston unit define a hydraulic working chamber into which a working connection and a further fluid connection open, wherein the fluid connection communicates hydraulically with the valve unit, which is configured as a seat valve unit having a supply connection and being switchable between a first switching position connecting the supply connection to the fluid connection and a second switching position blocking the fluid connection relative to the supply connection.

BACKGROUND OF THE INVENTION

Such hydromechanical linear converters are known in various configurations and are used in particular in hydraulic machine presses and plastic injection moulding machines. DE 10 2016 118 853 B3, for example, is relevant in this respect, from which in particular the function of a hydromechanical linear converter within an electrohydraulic drive unit results and to which reference is made and referred to in order to avoid unnecessary repetition.

Hydromechanical linear converters of the concerned type have proven themselves in practical use. Pressing processes, plastic injection moulding processes or similar, as they are made possible by machines with such linear converters, are characterised, for example, by excellent reproducibility and thus high manufacturing quality with a high degree of energy efficiency. The economic efficiency of the respective machine presses, plastic injection moulding machines or the like is influenced not only by the factors just mentioned, but also by the possible short cycle times.

It is therefore one of the characteristics of such hydromechanical linear converters that the piston of the hydromechanical linear converter is moved in a so-called rapid traverse as well as in a so-called power traverse within a working cycle. In the power traverse, the hydraulic working chamber is pressurized with hydraulic fluid by, for example, a hydraulic pump in its pumping mode, whereby high forces can be exerted on the piston, which—depending on the application of the hydromechanical linear converter—can be used to act on workpieces or machine components in the desired manner. In rapid traverse, on the other hand, the focus is not on exerting large forces on the workpiece or a machine component, but, with a view to reducing cycle times, on moving the piston unit quickly. For this purpose, the piston unit is moved by suitable external forces (for example the weight of the piston unit or a tool connected to it or an auxiliary drive acting on the piston unit) and by switching the valve unit to the first switching position, it is possible for hydraulic fluid to flow into or out of the hydraulic working chamber via the valve unit and its supply connection, depending on the direction of movement of the piston unit.

SUMMARY OF THE INVENTION

It is the object of the present invention to provide a hydromechanical linear converter which has been further improved in terms of economy, energy efficiency, compactness and the possibilities of process optimization.

This object is solved by using a hydromechanical linear converter of the type mentioned above, where the valve unit comprises

- a valve housing having a valve seat,
- a valve body movable along a valve axis relative to the valve housing, with a valve head cooperating with the valve seat,
- a spring unit which preloads the valve body into a position corresponding to the first switching position of the valve unit, in which its valve head is lifted from the valve seat, and
- an electromagnetic actuator acting on the valve body via a purely mechanical actuation chain and by means of which the valve body can be adjusted against the force of the spring unit into a position corresponding to the second switching position of the valve unit, in which its valve head rests sealingly on the valve seat, wherein the valve body is sealingly guided in the valve housing in such a way that together with the latter it delimits a hydraulic operating chamber which communicates hydraulically with the fluid connection via a compensation channel and the pressurisation of which acts on the valve body in the opposite direction to the spring unit. Furthermore, in a projection along the valve axis, the surface portions of the valve body limiting the hydraulic operating chamber are larger than those surface portions of the valve body exposed to the pressure prevailing in the fluid connection in the second switching position of the valve unit, the pressurization of which acts on the valve body in the same direction as the spring unit.

In the linear converter according to the invention, mechanical, electromagnetic as well as hydraulic effects are used for switching and hydraulically shutting off the fluid connection from the supply connection (including holding the respective second switching position). In interaction, the spring unit and the electromagnetic actuator—depending on its electrical loading—move the valve body into the first or the second of the two switching positions, but in the second switching position a hydraulic force, which acts on the valve body from the hydraulic operating chamber, ensures that the valve head is in sealing contact with the valve seat, thus enabling the fluid connection to be reliably shut off from the supply connection even at high pressures in the hydraulic working chamber of the linear converter. The said hydraulic operating chamber (also) communicates through the compensation channel when the valve unit—with the valve head in contact with the valve seat—is in the second switching position, which shuts off the fluid connection from the supply connection. As a result, such a pressure—adjusted to the pressure conditions in the hydraulic working chamber of the linear converter—builds up in the hydraulic operating chamber, which causes the valve body to be hydraulically self-retaining, so that the second switching position is reliably maintained even when the electromagnetic actuator is currentless.

In a surprisingly simple way, this contributes to a substantially improved usability of the hydromechanical linear converter compared to the prior art, as the economic efficiency, the energy efficiency, the compactness as well as the possibilities of process optimization can be improved at the same time:

By using a hydraulic force to seal the valve head against the valve seat, this task does not have to be performed by the electromagnetic actuator, which enables the use of a relatively compact electromagnetic actuator and thus has a positive effect on space requirements and cost reduction.

Due to the configuration of the hydromechanical linear converter according to the invention, it can be used without the need for too much adaptation (and thus very economically) in some machines in which up to now only linear converters with electrohydraulic valve units (i.e. valve units in which the valve body is moved to the individual switching positions by a hydraulic actuator) have been used. Electromagnetic actuation of the valve unit opens up possibilities for process optimization (compared to electrohydraulic actuation), since the valve unit can be reliably actuated even if only a low system pressure is available in the hydraulic system. In other words: With an electromagnetically actuated valve unit, it is not necessary to start up the hydraulic unit, if hydraulic energy is not required for other purposes, especially only for the provision of hydraulic energy for actuating the valve unit. In addition to increased energy efficiency, this also benefits the service life of the entire machine. Enabling this, the hydromechanical linear converter, which is based on the invention, helps to improve the possibilities for process optimization, energy efficiency and economy.

According to a first preferred embodiment of the invention, the valve housing comprises a base body and a pot-shaped insert disposed therein, which forms the valve seat and has at least one peripheral opening. In this configuration, the advantage of compactness is particularly pronounced. Furthermore, due to the ruggedness of the configuration, this embodiment has advantages with regard to the service life of the hydromechanical linear converter. Preferably, the base body is a multi-part element, preferably two-part element, with a base structure comprising the fluid connection and supply connection and a cover. To a certain extent, the insert can be clamped between the base structure and the cover. This makes the valve unit particularly easy to manufacture and install, which has a positive effect on manufacturing, assembly and maintenance costs.

The valve body described above is preferably sealingly guided in the insert. In this way, the sealing of the hydraulic operating chamber can be achieved very economically without the use of further components.

In a further preferred embodiment, the hydromechanical linear converter according to the invention is characterized in that the valve body comprises a valve pot and a valve stem fixedly connected to it, whereby a bottom of the valve pot forms the valve head. The electromagnetic actuator acts on the valve stem. Preferably, a basket fixed to the housing protrudes into the valve pot, the spring unit being formed by a return spring surrounding the valve stem and supported on the basket. This ensures in a very compact manner that the return spring can act on the valve body via the valve stem and the valve body can thus be preloaded into a position corresponding to the first switching position of the valve unit.

Although the electromagnetic actuator in the context of the present invention can also be configured in other ways (e.g. as an electric linear motor), it is preferably configured as a solenoid unit for typical applications. For certain applications, it may be advantageous to dispose the solenoid (or the electromagnetic actuator designed in another way) in the hydraulic operating chamber, especially with regard to sealing. For typical applications, however, the advantages associated with disposing the solenoid unit (or other type of electromagnetic actuator) on the outside of the valve body outweigh the advantages associated with mounting the solenoid unit (or other type of electromagnetic actuator) on the outside of the valve body (including good mountability and accessibility of the electromagnetic actuator), even if this requires a moving part (e.g. an armature rod of the solenoid unit or the valve stem) to pass through the valve body (see below).

In the above sense, the solenoid unit preferably comprises an armature with an armature rod and an armature tube which receives (and possibly guides) the armature rod and is sealed tightly on one side. The armature of the linear solenoid unit preferably works "under oil". The interior of the armature tube can communicate with the hydraulic operating chamber to ensure constant pressure compensation through the opening in the valve housing through which the armature rod, the valve stem or a separate tappet arranged between these components passes. This means that there is no need for dynamic sealing of the armature rod, the tappet or the valve stem, which allows for low friction and thus enables the use of a particularly efficient solenoid unit. However, the armature tube must be able to withstand high pressures (possibly by means of a housing supporting it), namely the maximum operating pressure in the hydraulic working chamber of the linear converter.

In the light of the latter aspect, the alternative is particularly advantageous where the valve stem, the armature rod or a separate tappet arranged between the valve stem and the armature rod is passed through the valve body at least in a substantially sealing manner and the interior of the armature tube communicates with the supply connection via a relief line. In this configuration, in order to avoid the friction associated with a 100% reliable seal between the valve stem/armature rod/tappet on the one hand and the valve housing on the other hand, a certain amount of slight oil leakage is permitted in the relevant passage towards the solenoid unit; however, the leakage oil in question does not build up any pressure in the armature tube, as it can flow off (unpressurised) through the relief line to the supply connection. This configuration places particularly low mechanical demands on the solenoid unit.

Another preferred further embodiment of the invention is that the valve seat is located between the fluid connection and the valve head. In this case—in the second switching position of the valve unit—the valve head rests against the valve seat on the side opposite the fluid connection. In this case, the surface portions of the valve body that are exposed to the pressure prevailing in the fluid connection in the second switching position of the valve unit and whose pressurization acts on the valve body in the same direction as the spring unit are primarily the surface of the valve head resting on the valve seat that is exposed to the fluid connection and enclosed by the valve seat. In this case, the compensation channel is preferably formed by an opening through the bottom of the valve pot. In this way, the hydraulic connection between the hydraulic working chamber and the hydraulic operating chamber can be established with very simple means, which has a positive effect on the manufacturing complexity as well as robustness and service life.

However, in functional reversal of the preferred configuration of the invention set out above, the valve seat may also be located between the supply connection and the valve head, so that the valve head—in the second switching position of the valve unit—abuts the valve seat on the side opposite the supply connection. This also represents a very advantageous configuration of the present invention. As those surface portions of the valve body which are exposed to the pressure prevailing in the fluid connection in the second switching position of the valve unit and whose pressurization acts on the valve body in the same direction as the spring unit, in this case primarily that portion of the end surface of the valve head is considered which surrounds the sealing surface acting together with the valve seat on the outside. Preferably, the compensation channel is formed by an opening through the side wall of the valve pot in this case.

Another preferred further embodiment of the inventive hydraulic linear converter is characterized in that the electromagnetic actuator is not energized in the first switching position. The valve body, as far as the above-mentioned hydraulic self-retaining mechanism is not effective, is moved by the spring unit into a position corresponding to the first switching position when the electromagnetic actuator is currentless, in which its valve head is lifted from the valve seat and the supply connection and the fluid connection are hydraulically connected.

According to another preferred further embodiment of the invention, the valve body can be brought into at least one intermediate position lying between the first and second switching position of the valve unit by means of the electromagnetic actuator. This enables the valve unit to assume an additional functionality, in particular as an effective flow throttle or fluid brake when the flow path between the fluid connection and the supply connection is only partially open when the valve body is brought into the intermediate position. This is the simplest way to achieve a stabilizing damping effect—which can be adjusted if necessary—in a suitable hydraulic environment. This allows a targeted influence on the pressure and flow conditions prevailing in the linear converter according to the invention with minimum effort; a substantial further improvement in the usability and extended applicability of the linear converter is the result.

Just to avoid misconceptions, it should be pointed out as a precautionary measure that the term "supply connection" must never be used to imply that the direction of flow through the valve unit from the supply connection to the fluid connection is mandatory. On the contrary, as already mentioned above, a reverse flow through the valve unit is also possible.

In the interest of increased flexibility of the inventive hydraulic linear converter, the hydraulic operating chamber communicates particularly preferentially with the supply connection of the valve unit via a bypass line with a shut-off valve arranged therein. In this way, the hydraulic operating chamber can be depressurized independently of the pressure conditions in the hydraulic working chamber, thus eliminating the hydraulic self-locking effect described above. This represents an additional safety functionality, because as a result the valve unit can be opened even under pressure in the hydraulic working chamber. As the hydraulic working chamber is connected to the hydraulic operating chamber through the compensation channel, the pressure in the hydraulic working chamber can also be reduced in a targeted manner—towards the supply connection—via the above-mentioned bypass line, even if the valve unit is (still) closed.

BRIEF DESCRIPTION OF THE DRAWINGS

In the following, the present invention is explained in more detail by means of two preferred exemplary embodiments illustrated in the drawing. Thereby

DETAILED DESCRIPTION OF THE INVENTION

Figure 1:
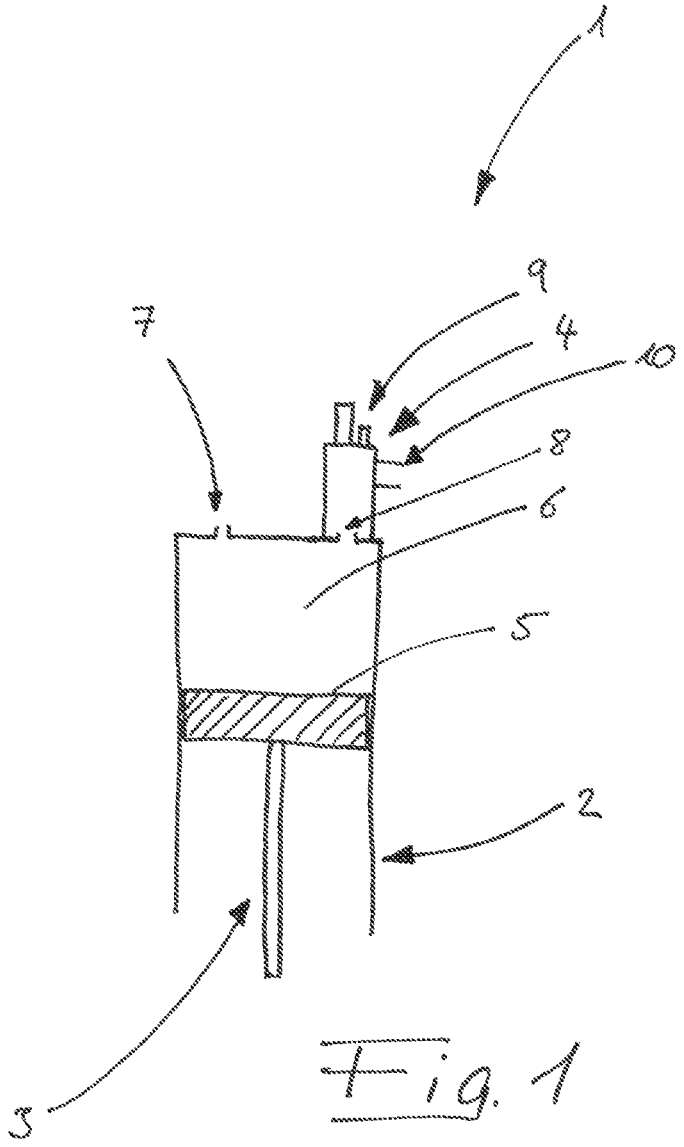
FIG. 1 is a schematic view of a hydromechanical linear converter according to the invention.

The hydromechanical linear converter 1 illustrated in the drawing comprises, as known from the state of the art and therefore not explained in detail at this point, a cylinder 2, a piston unit 3 movable relative to it and a valve unit 4. The cylinder 2 and a piston 5 of the piston unit 3 define a hydraulic working chamber 6 into which a working connection 7 and a further fluid connection 8 open, the fluid connection communicating hydraulically with the valve unit 4. The valve unit 4 is configured as a seat valve unit 9 and comprises a supply connection 10 and can be switched between a first switching position connecting the supply connection 10 with the fluid connection 8 (shown in FIG. 2) and a second switching position shutting off the fluid connection 8 from the supply connection 10.

The valve unit 4 comprises a valve housing 11, a valve body 12, a spring unit 13 and an electromagnetic actuator 14. The valve housing 11 comprises a pot-shaped insert 15 which forms the valve seat 16 and—in its peripheral wall—has several peripheral openings 17, and a two-part base body 18 with a base structure 19 having the supply connection 10 and the fluid connection 8 and a cover 20. Base structure 19 and cover 20 are firmly connected to each other with suitable (not shown) fastening means. They accommodate the insert 15 between them, whereby the insert 15 is sealed at the end face against the base structure 19 and the cover 20 by means of associated seals.

The valve body 12 can be moved along a valve axis A relative to the valve body 11. It comprises a valve pot 21—having a substantially cylindrical circumferential wall and a bottom—and a valve stem 22 which is firmly connected to the bottom of the valve pot 21, the bottom of the valve pot 21 forming the valve head 23 which cooperates with the valve seat 16. The valve seat 16 is located between the fluid connection 8 and the valve head 23. The spring unit 13 pretensions the valve body 12 to a position corresponding to the first switching position of the valve unit, in which the valve head 23 is lifted from the valve seat 16.

A compensation channel 24, configured as an opening 25, passes through the bottom of the valve pot 21, while the valve body 12 is sealingly guided in the valve housing 11—namely in its insert 15—in such a way that together with the latter it delimits a hydraulic operating chamber 26. In a projection along the valve axis A, the hydraulic operating chamber 26 is essentially limited by two surface portions of the valve pot 21, namely the surface of the bottom facing the interior of the valve pot (minus the surfaces of the opening 25 and the valve stem 22) and the annular end face of the circumferential wall. The sum of these surface portions, over which a force acting on the valve body 12 in the opposite direction to the operating direction of the spring unit 13 results when pressure is applied to the hydraulic operating chamber 26, is greater than the surface of the valve head 23 resting on the valve seat 16 being surrounded by the valve seat 16 and being exposed to the fluid connection 8. The hydraulic operating chamber 26 communicates hydraulically with the fluid connection 8 via the compensation channel 24, so that pressure compensation between the fluid connection 8 and the hydraulic operating chamber 26 is ensured.

A hydraulic connection between the hydraulic operating chamber 26 and the supply connection 10 can be established via a bypass line 27 with a shut-off valve 28, which is also electromagnetically operated.

A basket 29 fixed to the housing projects into the valve cup 21, on which is supported a helical return spring 30 surrounding the valve stem 22 and forming the spring unit 13. Its second end is supported by a collar of the valve stem 22.

The electromagnetic actuator 14 acts on the valve body 12 via a purely mechanical actuation chain. It moves the valve body 12 against the force of the spring unit 13 into a position corresponding to the second switching position of the valve unit, in which the valve head 23 rests sealingly on the valve seat 16.

The electromagnetic actuator 14 is configured as a solenoid unit 31, which comprises an armature with an armature stem 32 acting on the valve stem 22 and a pressure-tight armature tube which receives and guides the armature and is closed at one end. By means of an adapter 33 attached to the cover 20 of the valve housing, the solenoid unit 31 is firmly and tightly connected to the valve housing 11 in such a way that the interior of the armature tube is constantly exposed to the pressure prevailing in the hydraulic operating chamber 26. The corresponding constant pressure compensation takes place along the armature rod, which is guided with appropriate clearance.

Other configurations of the electromagnetic actuator (e.g. as an electric linear actuator) are advantageously possible in the same way (see above), in particular to enable the valve body to be adjusted to several different intermediate positions. From FIG. 2, considering the explanations on this further embodiment, it is easy to derive the reverse functional design described above, in which the fluid connection 8 and the supply connection 10 are essentially interchanged and the opening 25 connecting the fluid connection 8 to the hydraulic operating chamber 26 does not penetrate the bottom of the valve pot 21, but rather its circumferential wall. In accordance with the change of the supply connection 10, the bypass line 27, which connects it to the hydraulically active chamber, would also have to be changed.

Figure 2:
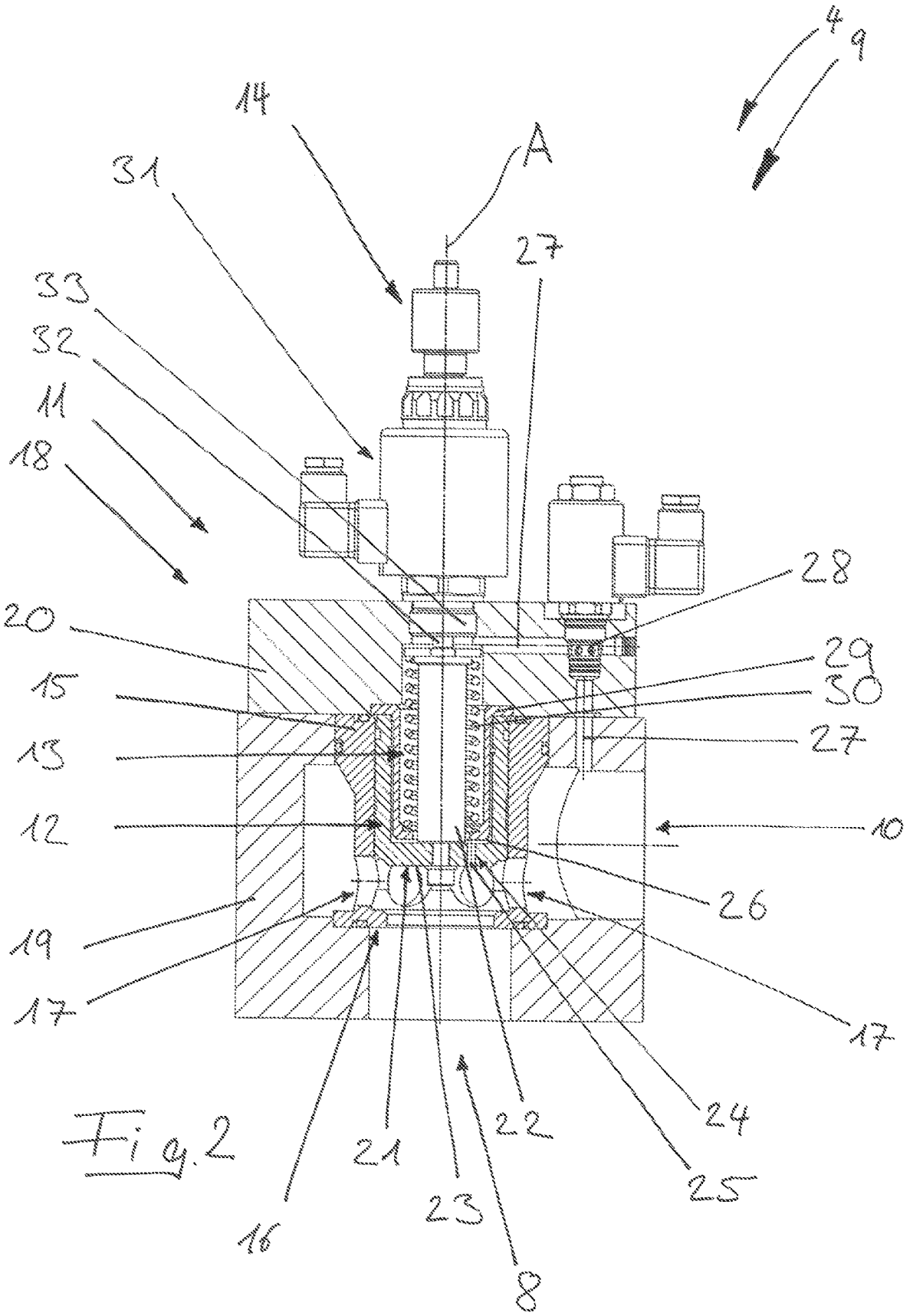
FIG. 2 is a detail of a valve unit in its first switching position which can be used with the linear converter according to FIG. 1.
Figure 3:
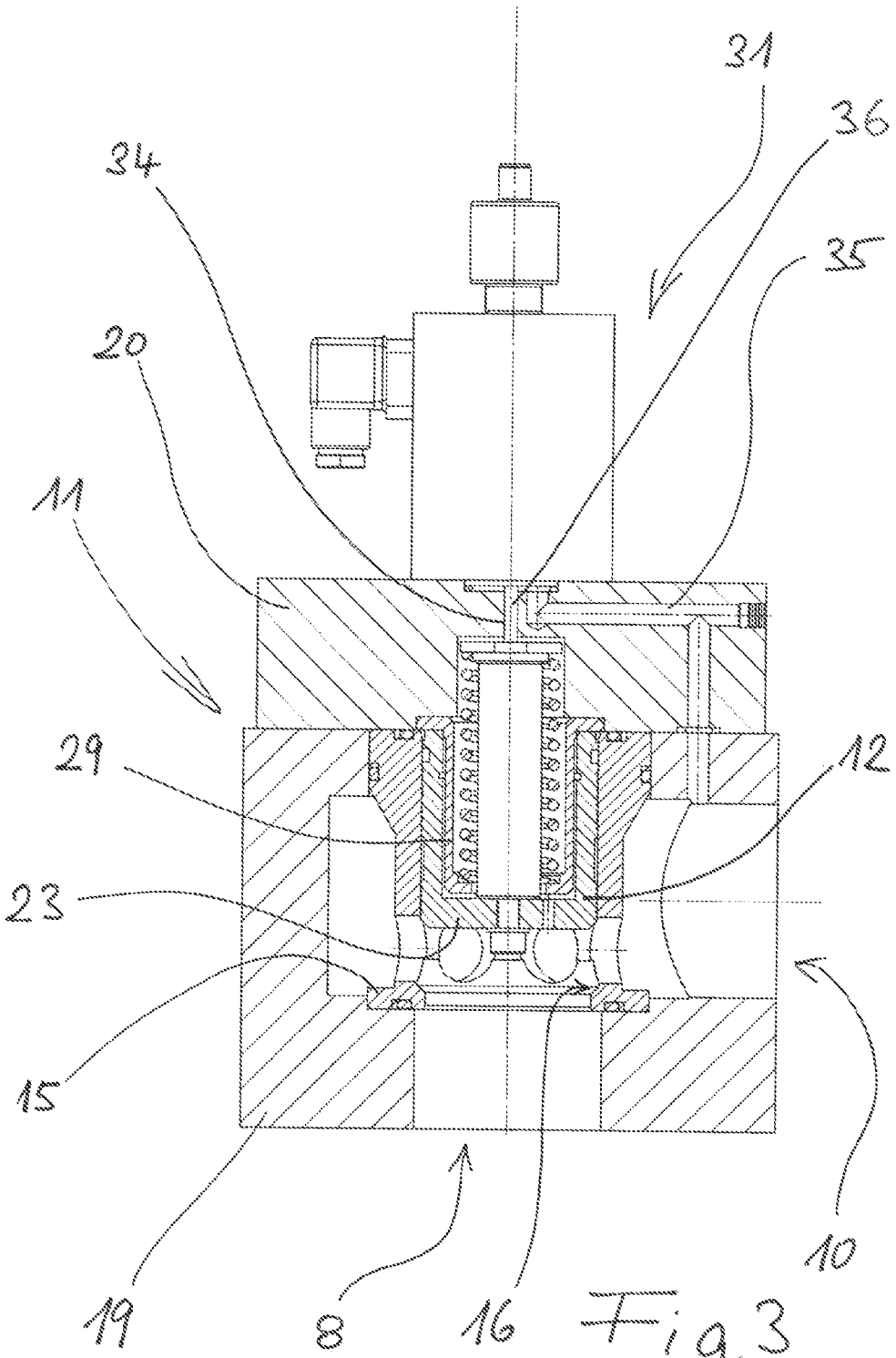
FIG. 3 is a modified version of the valve unit according to FIG. 2.

The modified embodiment illustrated in FIG. 3 differs from that shown in FIG. 2 essentially in that it is not the interior of the armature tube that communicates with the hydraulic operating chamber in the sense of constant pressure compensation, but rather a tappet 36 arranged in a force-transmitting manner between the armature of the solenoid unit 31 and the valve stem 22, which passes at least essentially sealingly through an opening 34 in the cover 20 and the valve housing 11. The interior of the armature tube communicates constantly with the supply connection 10 via a relief line 35, so that leakage oil quantities that enter the armature tube along the armature rod 32' through the opening 35 can flow constantly into the (unpressurised) supply connection 10, thus preventing a pressure build-up in the armature tube.

The invention claimed is:

1. A hydromechanical linear converter comprising:

a cylinder;

a piston unit movable relative to the cylinder and having a piston, the cylinder and the piston of the piston unit delimiting a hydraulic working chamber;

a working connection and a further fluid connection opening into the hydraulic working chamber;

a valve unit, the fluid connection communicating hydraulically with the valve unit, the valve unit configured as a seat valve unit having a supply connection, the valve unit being switchable between a first switching position connecting the supply connection to the fluid connection and a second switching position blocking fluid relative to the supply connection, the valve unit comprising;

a valve housing having a valve seat;

a valve body movable along a valve axis relative to the valve housing and having a valve head cooperating with the valve seat;

a spring unit which preloads the valve body into a position corresponding to the first switching position of the valve unit, in which the valve head is lifted from the valve seat; and an electromagnetic actuator acting on the valve body via a purely mechanical action, the electromagnetic actuator operable to adjust the valve body against a force of the spring unit into a position corresponding to the second switching position of the valve unit, in which position the valve head rests sealingly on the valve seat;

wherein the valve body is sealingly guided in the valve housing in such a way that the valve body together with the valve housing delimits a hydraulic operating chamber, the hydraulic operating chamber communicating hydraulically with the fluid connection via a compensation channel and a pressurization of the hydraulic operating chamber acts on the valve body in an opposite direction to the spring unit; and wherein in a projection along the valve axis, surface portions of the valve body delimiting the hydraulic operating chamber are larger than surface portions of the valve body which are exposed to a pressure prevailing in the fluid connection in the second switching position of the valve unit, the pressurization of the fluid connection in the second switching position acting on the valve body in a same direction as the spring unit.

2. The hydromechanical linear converter according to claim 1, wherein the valve housing comprises a base body and a pot-like insert, the pot-like insert forming the valve seat and having at least one peripheral opening.

3. The hydromechanical linear converter according to claim 2, wherein the base body is configured as a multi-part element with a base structure and a cover, the base structure comprising the fluid connection and the supply connection.

4. The hydromechanical linear converter according to claim 2, wherein the valve body is sealingly guided in the insert.

5. The hydromechanical linear converter according to claim 1, wherein the valve body comprises a valve pot and a valve stem fixedly connected to the valve pot, the electromagnetic actuator acting on the valve step, a bottom of the valve pot forming the valve head.

6. The hydromechanical linear converter according to claim 5, wherein a basket fixed to the housing protrudes into the valve pot, the spring unit being supported on the basket in the form of a pressure-loaded return spring surrounding the valve stem.

7. The hydromechanical linear converter according to claim 5, wherein the electromagnetic actuator is configured as a solenoid unit which is mounted on an outside of the valve housing and comprises an armature having an armature rod and an armature tube which receives the armature rod and is tightly closed on one side.

8. The hydromechanical linear converter according to claim 7, wherein an interior of the armature tube communicates with the hydraulic operating chamber as a continuous pressure compensation.

9. The hydromechanical linear converter according to claim 7, wherein the valve stem, the armature rod or a separate tappet arranged between the valve stem and the armature rod passes through an opening of the valve housing in an at least substantially sealing manner and the interior of the armature tube communicates with the supply connection via a relief line.

10. The hydromechanical linear converter according to claim 5, wherein the valve seat is arranged between the fluid connection and the valve head and the compensation channel is formed by an opening passing through the bottom of the valve pot.

11. The hydromechanical linear converter according to claim 5, wherein the valve seat is arranged between the supply connection and the valve head and the compensation channel is formed by an opening passing through the side wall of the valve pot.

12. The hydromechanical linear converter according to claim 1, wherein the electromagnetic actuator is disposed in the hydraulic operating chamber.

13. The hydromechanical linear converter according to claim 1, wherein the electromagnetic actuator is not energized in the first switching position of the valve unit.

14. The hydromechanical linear converter according to claim 1, wherein the hydraulic operating chamber communicates with the supply connection via a bypass line with a shut-off valve arranged therein.

15. The hydromechanical linear converter according to claim 1, wherein the valve body can be brought into at least one intermediate position by means of the electromagnetic actuator, the intermediate position being between the first and the second switching position of the valve unit.

* * * * *